US006948790B2

(12) United States Patent
Shepherd et al.

(10) Patent No.: US 6,948,790 B2
(45) Date of Patent: Sep. 27, 2005

(54) NON-UNIFORM RESOLUTIONS FOR PRINTING

(75) Inventors: Matthew A. Shepherd, Vancouver, WA (US); Jason M. Quintana, Brush Prairie, WA (US); Marc Yousey, Portland, OR (US); Dawn Beachnau Hood, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 116 days.

(21) Appl. No.: 10/616,803

(22) Filed: Jul. 10, 2003

(65) Prior Publication Data

US 2005/0007405 A1 Jan. 13, 2005

(51) Int. Cl.[7] ..... B41J 29/38; B41B 1/00
(52) U.S. Cl. ..... 347/12; 358/1.2
(58) Field of Search ..... 347/12, 5, 15, 347/41; 358/1.2, 1.9

(56) References Cited

U.S. PATENT DOCUMENTS

| | | | | |
|---|---|---|---|---|
| 5,719,601 | A | 2/1998 | Moore | |
| 5,790,150 | A | 8/1998 | Lidke et al. | |
| 6,145,959 | A | 11/2000 | Lund et al. | |
| 6,491,372 | B1 * | 12/2002 | Shioya et al. | 347/41 |
| 6,533,393 | B1 | 3/2003 | Meyer et al. | |
| 6,729,710 | B2 * | 5/2004 | Chikuma et al. | 347/14 |

FOREIGN PATENT DOCUMENTS

| | | |
|---|---|---|
| EP | 0 513 989 | 11/1992 |
| EP | 1 176 021 | 1/2002 |
| EP | 1 364 797 | 11/2003 |

* cited by examiner

*Primary Examiner*—K. Feggins
*Assistant Examiner*—Julian D. Huffman

(57) ABSTRACT

Systems, methods and devices are provided for non-uniform resolutions in printing. In one embodiment, a printing method includes receiving a print job. The method further includes performing the print job. Performing the print job includes printing non-uniform resolutions per raster in a contiguous block of rasters.

16 Claims, 10 Drawing Sheets

NON-UNIFORM RESOLUTIONS FOR PRINTING

Each printhead has an arrangement of nozzles through which ink drops are controllably ejected onto the print media. The nozzles are arranged in an array of vertical columns and horizontal rows. The vertical DPI (dots per inch) of a given printhead is the pitch of dots that a printhead can print in a single printhead scan.

Independent of the vertical and horizontal DPI of the printhead, for a given media and quality selected in a printer driver, data is represented to be printed at a particular horizontal and vertical DPI. This "data resolution" can be below, at, or above the horizontal/vertical DPI of the individual scans that will be used to print the data. Each horizontal row in the data is termed to be a raster, such that the pitch of the rasters is the vertical DPI of the data. Contiguous vertical blocks of rasters can be referred to as a region.

The particular combination of scans, ink drop emission during each printhead scan, and the amount and timing of the media advance used to print on the media can be referred to as a "print mode". A selected print mode will have a particular horizontal resolution setting, e.g. 600 horizontal DPI. The speed of a printhead scan is connected to the ability of the printhead to perform a selected horizontal resolution setting, e.g. resolution per physical pass of a nozzle over a raster A given contiguous vertical region, or block, of rasters is completed in a single print mode. All of the data, having a single print mode algorithm, is completed for a particular region before the print mode is changed. Thus, all rasters in a contiguous vertical block of rasters are printed using the same uniform resolution and speed within a given region. If a user wants a faster print mode and is willing to give up some image quality (IQ), then either (a) fewer passes and/or (b) lower resolutions can be used. Both (a) and (b) result in faster printing, but also result in either lower IQ or lower robustness to nozzle defects. The results can be rather coarse steps in speed versus IQ. Hence, a next faster mode can produce a recognizable drop in IQ robustness.

DETAILED DESCRIPTION

Figure 1A:
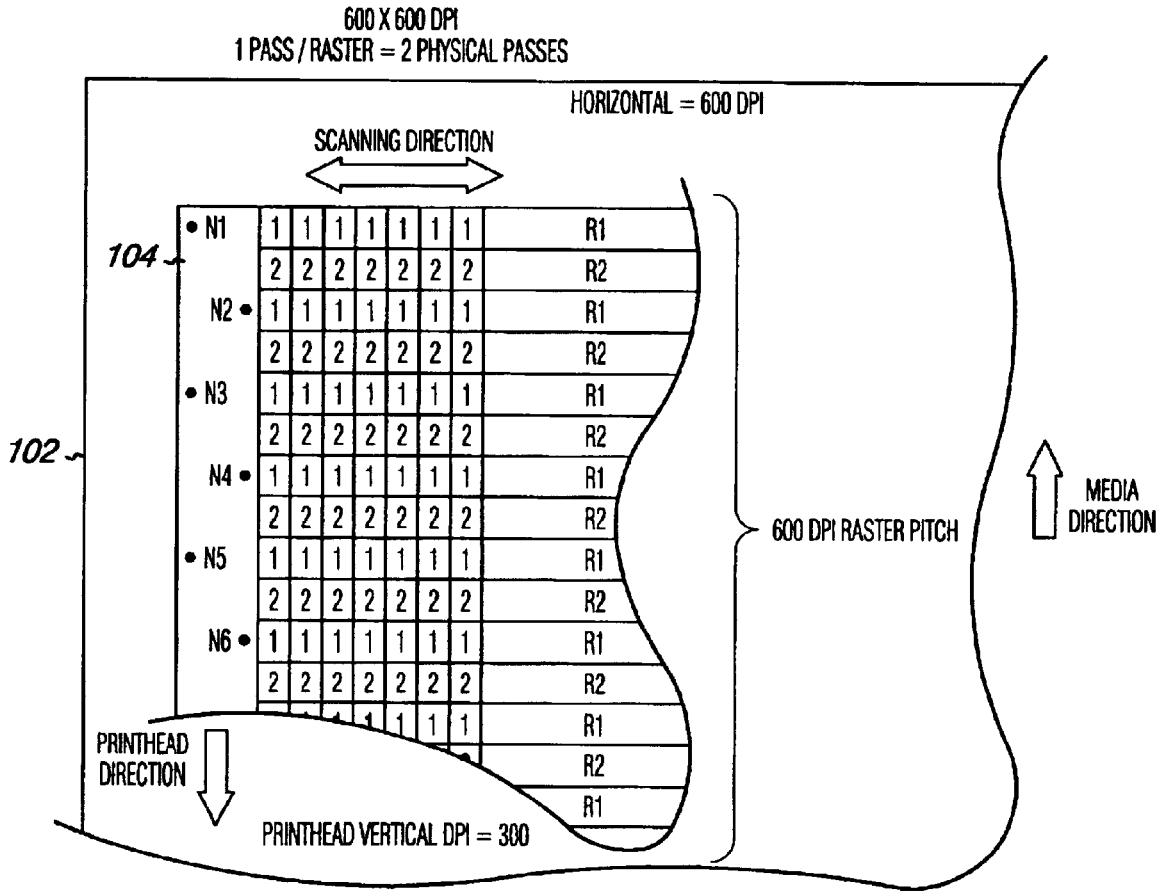
FIGS. 1A and 1B illustrate printing approaches using a single print mode in a region.

In order to form high quality text and images on media, multiple passes of the printhead arrangement can be employed either to: (1) print all of the rasters of the data when the printhead resolution is below the data resolution, (2) make multiple drops per data location, and/or (3) to hide errors using redundancy to fully print all the pixels of an individual region.

As an example of (2), a print job may be received with a data resolution of 600 horizontal and vertical DPI by 2 bit halftoning. The 2 bits represent 0, 1, and >1 drops per pixel. The printhead, however, may be set to a print mode of only 600 horizontal DPI (e.g. plain print mode) and have only a 300 vertical DPI. In this case, at least two scans per raster and four scans per region of the page would be made since a single scan can only place dots at half of the horizontal and vertical positions.

A variety of data resolutions exist depending on the media and quality that a user selects. And, as note above, existing printing devices can be set to a variety of print modes. However, the printhead has a fixed vertical resolution. The minimum number of physical printhead passes per horizontal raster line is equal to the horizontal data resolution DPI divided by the horizontal print mode selection. The minimum number of raster lines to be printed in the vertical direction is equal to the vertical data resolution DPI divided by the printhead vertical resolution DPI. Thus, the total number of physical printhead passes is function of the data resolution, the print mode selection and the printhead resolution.

As another example, a print job may be received with a data resolution of 600 horizontal and vertical DPI by 2 bit halftoning. The 2 bits represent 0, 1, and >1 drops per pixel. The printer may be set to a print mode of 1200 horizontal DPI (e.g. photo paper normal) and the printhead may have only a 300 vertical DPI. A given contiguous vertical region of rasters is completed in a single print mode. In this case, one scan per raster can achieve the 600 horizontal DPI by 2 bit halftoning data resolution using the horizontal print mode of 1200 horizontal DPI. Two scans per region of the page are made to achieve the 600 vertical DPI data resolution. However, a 1200 horizontal DPI resolution print mode selection consumes more time (e.g. impact the printhead scan speed) per pass than a pass made at a 600 horizontal DPI resolution print mode selection.

One factor considered by purchasers of inkjet printers is the speed at which a page of information can be printed, which in turn relates to the throughput, or the number of pages that can be printed in a given amount of time. Speed and throughput depend upon a number of factors. One factor is the number of times that the printhead arrangement scans an individual region in order to print all the pixels in the region—the more scans performed, the longer the printing time. As stated above, the number of scans performed depends on the type of information (resolution data, print mode, etc.) contained in the region.

Figure 1B:
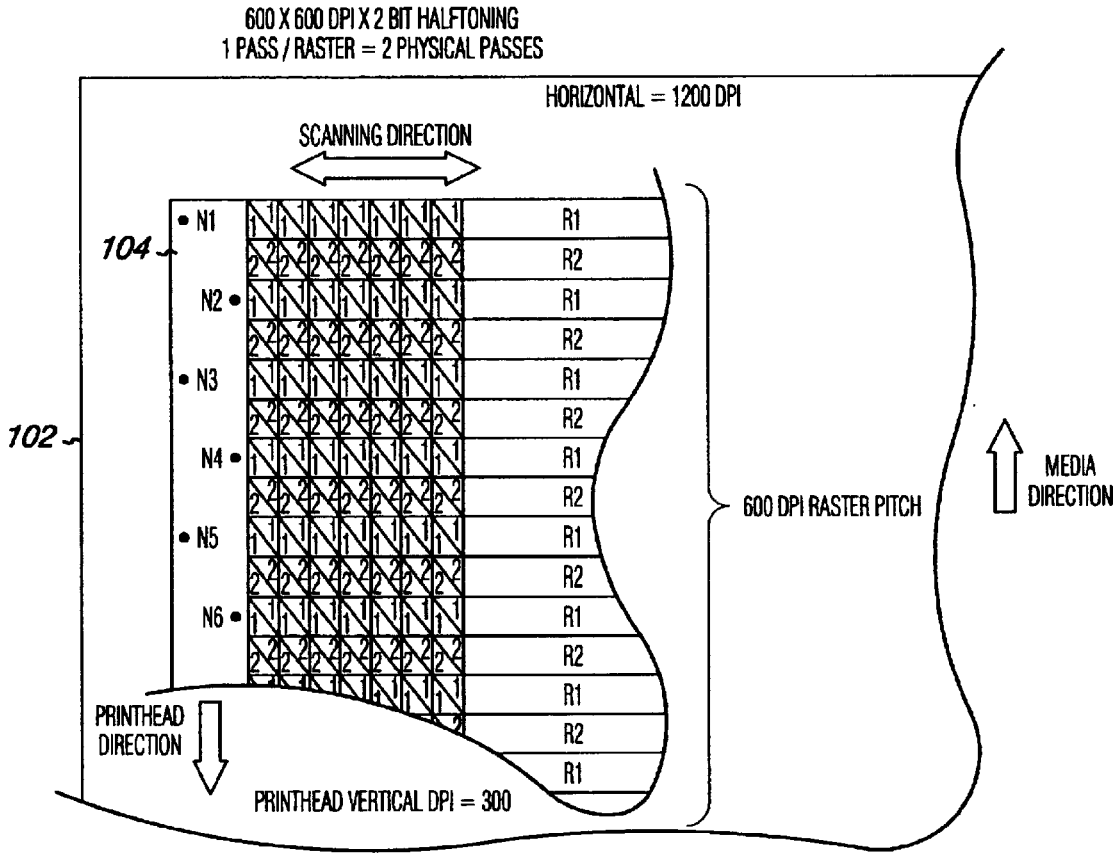

FIGS. 1A and 1B illustrate printing approaches using a single print mode in a region. For illustration purposes, a particular print job example is used. In this example, a plain/normal print job is provided, e.g. 600×600 DPI input data. In the example, the printhead has nozzles at 300 vertical dots per inch (DPI) and the print mode is for 600 horizontal DPI.

FIG. 1A illustrates one approach to performing this print job. In the embodiment shown in FIG. 1A, two passes at a horizontal resolution of 600 DPI, e.g. at the same resolution for each pass, are made for two different rasters, R1 and R2, over a print media 102. As noted, using a print mode of 600 horizontal DPI and a printhead, or pen 104, with 300 vertical DPI, one pass is made over each of two different rasters, R1 and R2, in order for the nozzles e.g. nozzles N1, N2, N3, N4, N5 and N6, to achieve 600×600 DPI output data in a contiguous block of rasters, or region.

As shown in FIG. 1A, this involves a first raster pass and a second raster pass by nozzle N1, in a single region. That is, nozzle N1 will make a first raster pass over raster R1. The nozzle N1 will then be incremented in position relative to the media 102 in order to make a second raster pass over raster R2. This is illustrated with single number (1) at each pixel location on the media 102 for raster R1 and a single number (2) at each pixel location on the media 102 for raster R2. Similarly, nozzles N2, N3, N4, N5 and N6, will also make a first and a second raster pass, in a single region, over respective raster lines denoted R1 and R2. With printhead nozzles at 300 vertical DPI two raster passes are used to achieve the 600 DPI vertically.

FIG. 1B illustrates another print mode for printing a contiguous vertical block of rasters. In the embodiment of 1B, a 600×600 DPI×2 bit halftoning (e.g. where more than one drop is deposited per pixel) print job, e.g. data resolution, is received. In the embodiment of FIG. 1B, a print mode is set to a horizontal resolution of 1200 DPI.

A single pass by nozzle N1, at a horizontal resolution of 1200 DPI, is made over raster R1. Similarly, nozzles N2, N3, N4, N5 and N6, will also make a single pass, at a horizontal resolution of 1200 DPI, over respective raster lines denoted R1. The nozzle N1 is then be incremented in position relative to the media 102 in order to make a second raster pass over raster R2. A single pass by nozzle N1, at a horizontal resolution of 1200 DPI, is made over raster R2. Likewise, nozzles N2, N3, N4, N5, and N6, will make a single pass, at a horizontal resolution of 1200 DPI, over raster lines denoted R2.

At a 1200 horizontal DPI print mode each raster pass can print more than one (1) drop per pixel to achieve 600 horizontal data resolution with 2 bit halftoning. This is illustrated with two numbers at each pixel location on the media 102 for each respective raster, e.g. two 1's in R1 and two 2's in R2. With printhead nozzles at 300 vertical DPI two raster passes are used to achieve the 600 DPI vertically within a contiguous block of rasters. However, a 1200 DPI horizontal resolution per printhead pass requires more time than a printhead pass at a 600 DPI horizontal resolution.

Since a given contiguous region, or block, of rasters is completed in a single print mode all rasters in the contiguous block of rasters are printed at the same horizontal DPI resolution print mode selection. The above described print mode solutions do not deliver a range of drops of ink per pixel, e.g. 0, 1, >1, at a throughput different from printing all of the rasters in the contiguous block of rasters, or region, at a horizontal resolution of either 600 or 1200 DPI. Accordingly, a relatively small design space exists for speed, resolution, and image quality trade-offs.

To illustrate, the image quality will be at 2 drops per pixel in a single printhead pass if the horizontal print mode is set to 1200 horizontal DPI or the image quality will be at 1 drop per pixel in a single printhead pass if the horizontal print mode is set to 600 horizontal DPI. Alternatively, if two physical printhead passes are made per raster, then 2 drops per pixel per raster can be achieved when the horizontal print mode is set to 600 horizontal DPI. However, four total printhead passes will be used to perform the 600×600 DPI×2 bit halftoning print job, e.g. input data, associated with a contiguous block of rasters.

Embodiments of the present invention provide an increase to print mode design space in multiple pass print modes. A non-uniform resolution per physical printhead pass is provided which allows for a faster print mode than pre-set alternatives yet still can accord with a user's desired media/image quality output.

Figure 2A:
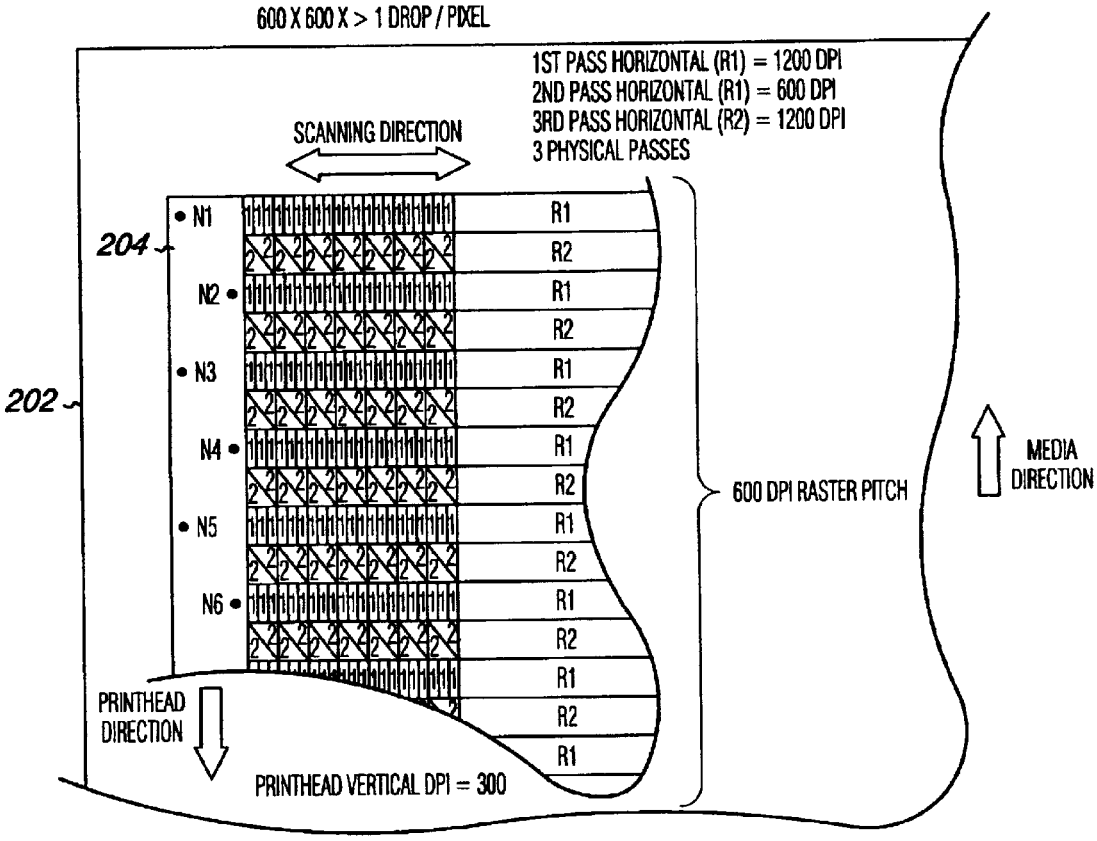
FIGS. 2A–2C illustrate embodiments of non-uniform resolution printing.
Figure 2B:
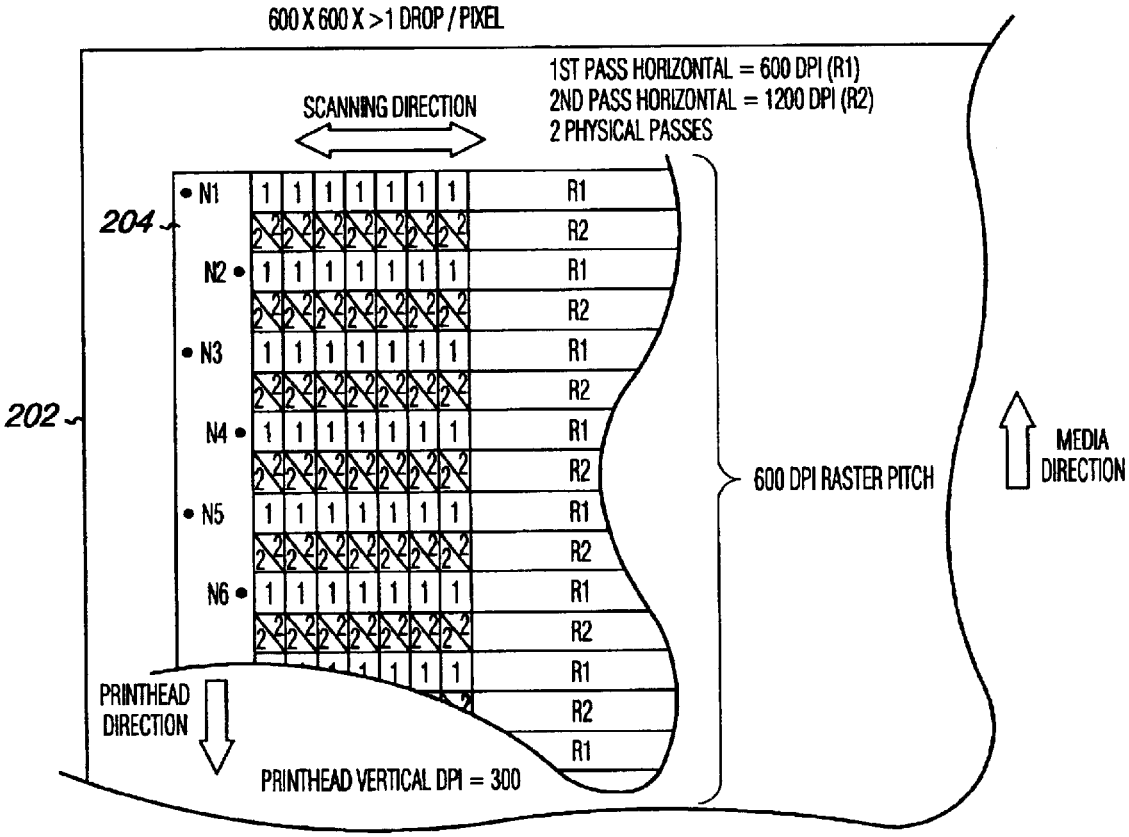
Figure 2C:
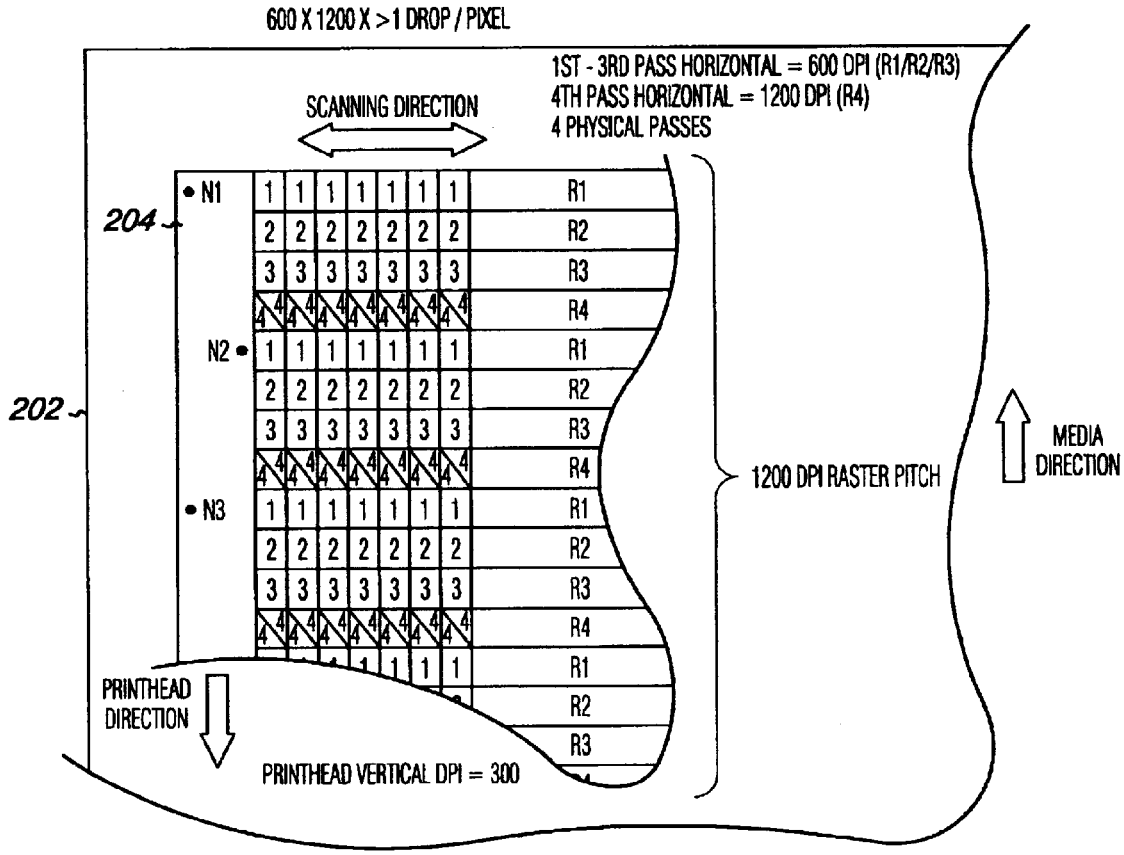

FIGS. 2A–2C illustrate embodiments of non-uniform resolutions per physical printhead pass. The various embodiments allow for intermediate resolution and image quality (IQ) tradeoffs to be made by using print mode algorithms that have non-uniform resolutions per physical printhead pass in a given contiguous block of rasters, or single region. Using the embodiments described herein, many other print mode options are possible.

As one of ordinary skill the art will understand, the embodiments can be performed by software, application modules, and computer executable instructions operable on the systems and devices shown herein or otherwise. The embodiments, however, are not limited to any particular operating environment or to software written in a particular programming language. Software, application modules and/or computer executable instructions, suitable for carrying out embodiments of the present invention, can be resident in one or more devices or locations or in several and even many locations.

FIG. 2A illustrates an embodiment of non-uniform printhead resolutions for rasters in a given region. In the embodiment of FIG. 2A, a print mode is illustrated for printing 600×600 DPI data, using a 300 vertical DPI printhead, together with the capability of printing more than an average of two drops per pixel in a contiguous block of rasters.

In the embodiment of FIG. 2A, a first pass by nozzle N1 over raster R1 is performed at a horizontal resolution of 1200 DPI. Since the received horizontal data is 600 DPI, two drops per pixel can be placed during the first pass at a horizontal resolution of 1200 DPI.

A second pass by nozzle N1 over raster R1 is performed at a horizontal resolution of 600 DPI. In this example, a third drop can be place at each of the pixel locations in raster R1. This is illustrated by three 1's at each pixel location for rasters R1. Similarly, nozzles N2, N3, N4, N5 and N6, will also make a first pass at a horizontal resolution of 1200 DPI and a second pass at a horizontal resolution of 600 DPI over respective raster lines denoted R1.

In the embodiment of FIG. 2A, nozzle N1 is incremented in position relative to the media 202 in order to make a first pass (third pass total) over raster R2. A first pass by nozzle N1 is made over raster R2 at a horizontal resolution of 1200 DPI. Similarly, nozzles N2, N3, N4, N5 and N6, will also make a first pass (third pass total) at a horizontal resolution of 1200 DPI over respective raster lines denoted R2. At a 1200 DPI horizontal resolution the printhead nozzles can deliver two drops of ink per pixel. This is illustrated with two number 2's at each pixel location on the media 202 for raster R2.

As illustrated in the embodiment of 2A, multiple passes over a selected raster, within a contiguous vertical block of rasters can be performed at different horizontal resolutions. In the embodiment of FIG. 2A a non-integral average number of drops per pixel in a contiguous block of rasters can be realized. Additionally, a fewer number of total printhead passes over a contiguous block of rasters can be utilized to achieve a user's desired media/image quality output than would be performed if all of the rasters in the contiguous block of raster were printed using the same horizontal resolution.

As used in this application, the term non-integral average number of drops per pixel is intended to mean an average number of drops per pixel in a contiguous block of rasters which is not evenly divisible by an integer. Examples include 1.25, 1.7, 2.5, etc., average drops per pixel in a contiguous block of rasters. The embodiments of the invention, however, are not limited to these examples.

FIG. 2B illustrates another embodiment of non-uniform printhead resolutions for rasters within a contiguous vertical block of rasters. In the embodiment of FIG. 2B, a print mode is illustrated for printing 600×600 DPI data, using a 300 vertical DPI printhead, together with the capability of printing a non-integral average number of drops per pixel in a contiguous block of rasters.

In the embodiment of FIG. 2B, a first pass by nozzle N1 is made over raster R1 at a horizontal resolution of 600 DPI. Similarly, nozzles N2, N3, N4, N5 and N6, will also make a first pass at a horizontal resolution of 600 DPI over respective raster lines denoted R1. At a 600 DPI horizontal resolution the printhead nozzles deliver one drop of ink per pixel. This is illustrated with a single number 1 at each pixel location on the media 102 for raster R1.

In the embodiment of FIG. 2B, the nozzle N1 is incremented in position relative to the media 202 in order to make a second pass over raster R2. The second pass by nozzle N1 is made over raster R2 at a horizontal resolution of 1200 DPI. Similarly, nozzles N2, N3, N4, N5 and N6, will also make a second pass over respective raster lines denoted R2 at a horizontal resolution of 1200 DPI. At a 1200 DPI horizontal resolution the printhead nozzles can deliver two drops of ink per pixel. This is illustrated with a two number 2's at each pixel location on the media 202 for raster R2.

In the embodiment of FIG. 2B, since the first pass over R1 does not attempt to deposit more than one (1) drop of ink per pixel in a single pass, the 600 horizontal DPI print mode, or first horizontal resolution, can achieve at least one drop of ink per pixel.

In the first pass over raster R2 by nozzle N1 a second horizontal resolution is used within the contiguous block of rasters. In the first pass over raster R2 by nozzle N1, more than one (1) drop of ink per pixel in a single pass is achieved since a 1200 DPI horizontal resolution can deliver two (2) drop of ink per pixel for 600 horizontal data.

As illustrated in the embodiment of 2B, different rasters can be printed at different horizontal resolutions to effectively print a non-integral average number of drops per pixel within a contiguous vertical block of rasters. Further, the amount of time consumed in printing a non-integral average number of drops per pixel within a contiguous vertical block of rasters is less than would be used to print all of the rasters, within a contiguous vertical block of rasters, with more than one drop of ink per pixel, e.g. using a single horizontal resolution for all of the rasters within a contiguous vertical block of rasters.

FIG. 2C illustrates another embodiment of non-uniform printhead resolutions for rasters in a given region. In the embodiment of FIG. 2C, a print mode is illustrated for printing 600×1200 DPI data, using a 300 vertical DPI printhead, together with the capability of printing a non-integral average number of drops per pixel in a contiguous block of rasters.

In the embodiment of FIG. 2C, a first pass by nozzle N1 is made over raster R1 at a 600 DPI horizontal resolution. In the embodiment of FIG. 2C, the nozzle N1 is incremented in position relative to the media 202 in order to make a first pass over raster R2. A first raster pass by nozzle N1 over raster R2 is made at a 600 DPI horizontal resolution. The nozzle N1 is incremented in position relative to the media 202 in order to make a first pass over raster R3. A first pass by nozzle N1 over raster R3 is made at a 600 DPI horizontal resolution.

Similarly, a first pass by nozzles N2, N3, N4, N5 and N6, is made over respective rasters R1, R2, and R3. This is illustrated with a single number at each pixel location on the media 202 for rasters R1, R2, and R3, e.g. single 1's in R1, single 2's in R2, and single 3's in R3. In the embodiment of FIG. 2C, a first pass over rasters R1, R2 and R3 at a 600 horizontal DPI print mode, or first horizontal resolution, can achieve at least one drop of ink per pixel for the 600 horizontal DPI data.

In order to achieve 1200 vertical DPI data using a 300 vertical DPI printhead, a printhead pass over a fourth raster, R4, will also be made by each nozzle N1, N2, N3, N4, N5 and N6, respectively.

In the embodiment of FIG. 2C, a first raster pass over raster R4 is made by each nozzle N1, N2, N3, N4, N5 and N6, respectively, at a different, or second, horizontal resolution. In this example, the first raster pass over raster R4 is performed at a 1200 DPI horizontal resolution. Accordingly, more than one (1) drop of ink per pixel is achievable in the first raster pass over raster R4 for a horizontal data resolution of 600 DPI. This is illustrated with two number 4's at each pixel location in raster R4.

As illustrated in the embodiment of 2C, different rasters can be printed at different horizontal resolutions to effectively print a non-integral average number of drops per pixel within a contiguous vertical block of rasters. Further, the amount of time consumed in printing a non-integral average number of drops per pixel within a contiguous vertical block of rasters is less than would be used to print all of the rasters, within a contiguous vertical block of rasters, with more than one drop of ink per pixel, e.g. using a single horizontal resolution for all of the rasters within a contiguous vertical block of rasters.

For example, the a non-integral average number of drops per pixel within a contiguous vertical block of rasters is performed in less time than would be used for printing two physical passes per rasters R1–R4, for a total of eight (8) passes, at a 600 DPI horizontal resolution, and in less time than printing a single pass per rasters R1–R4, for a total of four (4) passes, each at a 1200 DPI horizontal resolution.

According to embodiments described herein many variants on this theme can be achieved. Multiple passes over a selected raster, within a contiguous vertical block of rasters can be performed at different horizontal resolutions. A non-integral average number of drops per pixel in a contiguous block of rasters can be realized. And, the amount of time consumed in printing a non-integral average number of drops per pixel within a contiguous vertical block of rasters is less than would be used to print all of the rasters with more than one drop of ink per pixel using a single horizontal resolution for all of the rasters.

Figure 3:
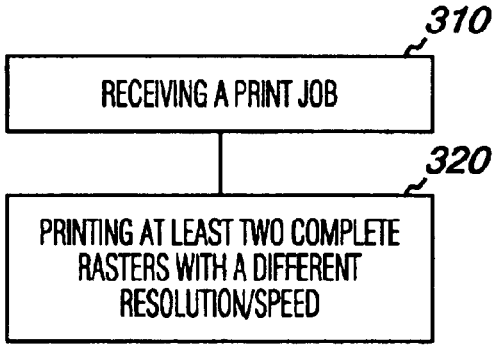
FIG. 3 illustrates a method embodiment for printing.
Figure 4:
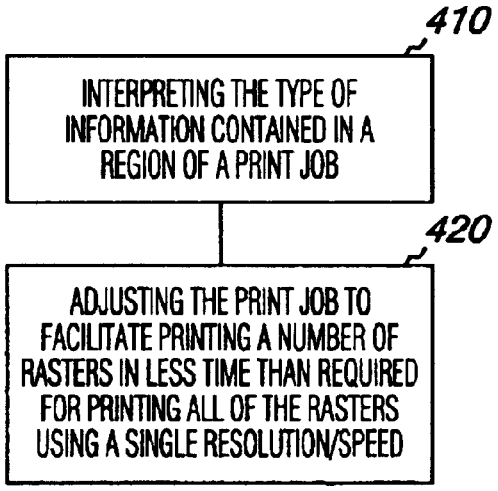
FIG. 4 illustrates a method embodiment for non-uniform resolution printing.

FIGS. 3 and 4 illustrate various method embodiments which provide for non-uniform resolutions for physical printhead passes in a given region. According to various embodiments, described herein, a non-uniform resolution for physical printhead passes in a given region accommodates a faster print mode than pre-set alternatives yet still can accommodate a desired media/image quality print mode combination. Intermediate speed and image quality (IQ) balances are realized using modes that have non-uniform resolutions for physical printhead passes within a contiguous vertical block of rasters. Accordingly, the print mode design space in multiple pass print modes can be increased.

Unless explicitly stated, the method embodiments described herein are not constrained to a particular order or sequence. Additionally, some of the described method embodiments can occur or be performed at the same point in time.

In the embodiment of FIG. 3, a method for printing images is provided. The method includes receiving a print job, as shown at block 310. The method further includes performing the print job. According to the method, performing the print job includes printing rasters, within a contiguous vertical block of rasters, at non-uniform printhead resolutions per physical printhead pass.

As shown in block 320, the method includes printing at least two complete printhead passes, or two physical rasters passes, at different resolutions within a contiguous vertical block of rasters. Printing non-uniform printhead resolutions for rasters in a given region includes printing a first raster pass at a first horizontal resolution and printing a second raster pass at a second horizontal resolution. The first raster pass and the second raster pass can be over the same raster. Printing non-uniform printhead resolutions for rasters within a contiguous vertical block of rasters can also include printing a first raster at a first horizontal resolution and printing a second, different raster at a second horizontal resolution. A third raster can be printed at a third horizontal resolution and a fourth raster can be printed at a fourth horizontal resolution.

Embodiments include printing odd rasters within a contiguous vertical block of rasters at a first horizontal resolution and printing even rasters within the contiguous vertical block of rasters at a second horizontal resolution. Embodiments include printing an $n^{th}$ raster within a contiguous vertical block of rasters at a different horizontal resolution from the other rasters within a contiguous vertical block of rasters, where the $n^{th}$ raster is selectable. The embodiments of the invention are not limited to these specific examples.

Printing rasters within a contiguous vertical block of rasters at different horizontal resolutions allows an average number of drops per pixel, greater than one, to be printed in less time than printing all of the rasters using a single resolution for all of the rasters in the contiguous block of rasters.

In the embodiment of FIG. 4, a method embodiment for printing non-uniform printhead resolutions for rasters in a given region is provided. The method includes interpreting a print job instruction set. According to the embodiment of FIG. 4, this includes interpreting the type of information contained in a print job for a region of media, as shown in block 410. Interpreting the type of information contained in a region of a print job includes interpreting resolution data and print mode settings.

The method includes modifying the print job instruction set to print non-uniform printhead resolutions for rasters in a given region. As shown in block 420, modifying includes adjusting the print job to facilitate printing a complete region in less time than used for printing the complete region using a single resolution for each raster pass of the region. This includes printing at least two full raster passes in the region at different horizontal resolutions.

Modifying the print job instruction set to print non-uniform printhead resolutions for rasters in a given region includes modifying the print job instruction set to print according to any of the various embodiments described in connection with FIG. 3.

Figure 5:
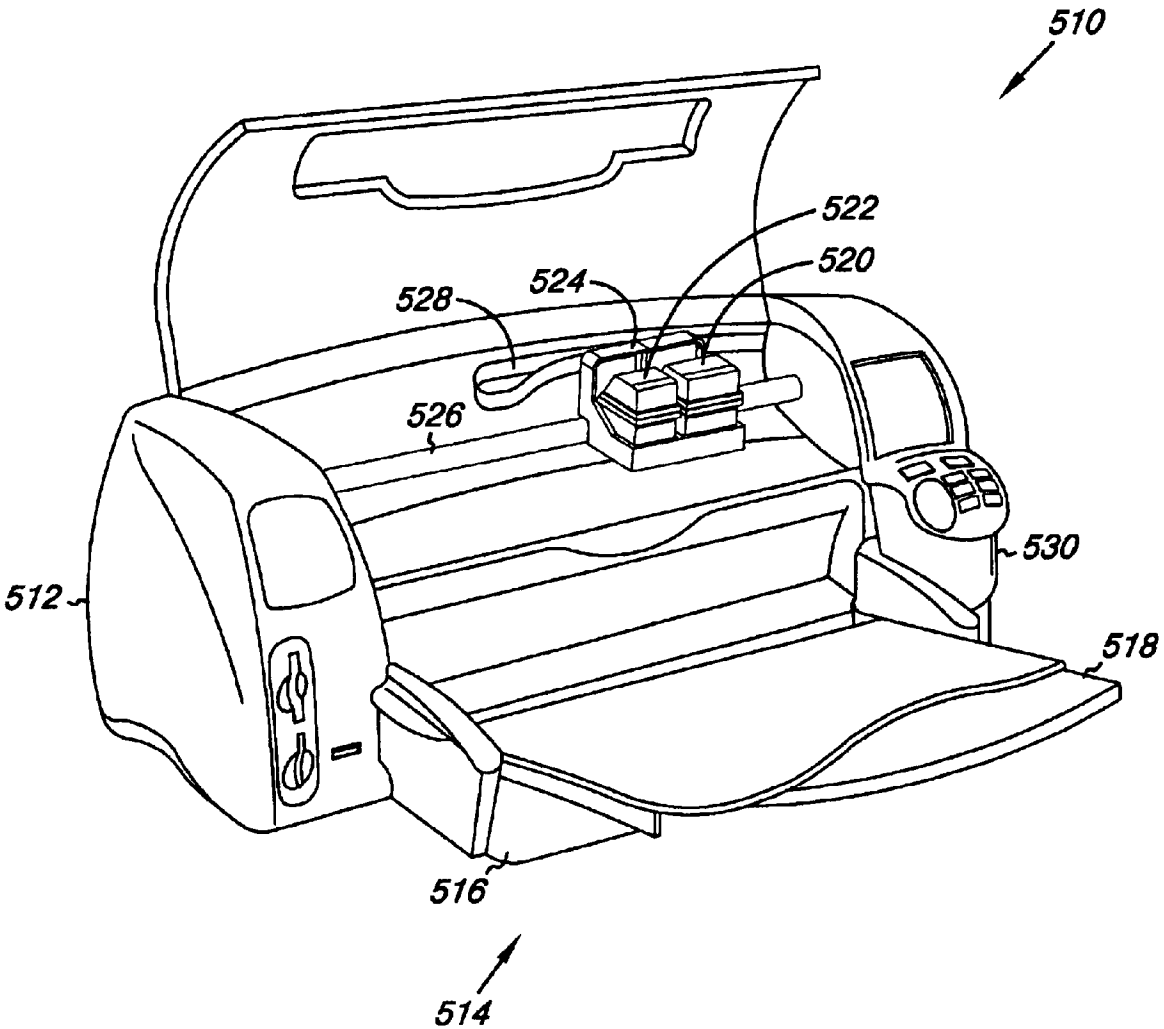
FIG. 5 illustrates a printing device with which embodiments can be implemented.

FIG. 5 provides a perspective illustration of an embodiment of a printing device which is operable to implement or which can include embodiments of the present invention. The embodiment of FIG. 5 illustrates an inkjet printer 510, which can be used in an office or home environment for business reports, correspondence, desktop publishing, pictures and the like. However, the invention is not so limited and can include other printers implementing various embodiments of the present invention. In the embodiment of FIG. 5, the printer 510 includes a chassis 512 and a print media handling system 514 for supplying one or more print media, such as a sheet of paper, business card, envelope, or high quality photo paper to the printer 510. The print media can include any type of material suitable for receiving an image, such as paper card-stock, transparencies, and the like.

In the embodiment of FIG. 5, the print media handling system 514 includes a feed tray 516, an output tray 518, and a printer drum or platen and rollers (not shown) for delivering sheets of print media into position for receiving ink from one or more inkjet printhead cartridges, shown in FIG. 5 as 520 and 522. In the embodiment of FIG. 5, inkjet printhead cartridge 520 can be a multi-color ink printhead cartridge and inkjet printhead cartridge 522 can be a black ink printhead cartridge. As shown in the embodiment of FIG. 5, the ink printhead cartridges 520 and 522 are transported by a carriage 524. The carriage 524 can be driven along a guide rod 526 by a drive belt/pulley and motor arrangement (not shown). The actual printhead type and motor control arrangement can vary among printing devices. In the embodiment of FIG. 5, the printhead cartridges 520 and 522 selectively deposit ink droplets on a sheet of paper or other print media in accordance with instructions received via a conductor strip 528 from a printer controller 530 which can be located within chassis 512. The controller 530 receives a set of print instructions, or print job, from a print driver. A print driver can reside in a computing device, such as a desktop, laptop, and the like, coupled to the printing device 510 via a network and can also reside in the printing device 510.

Figure 6:
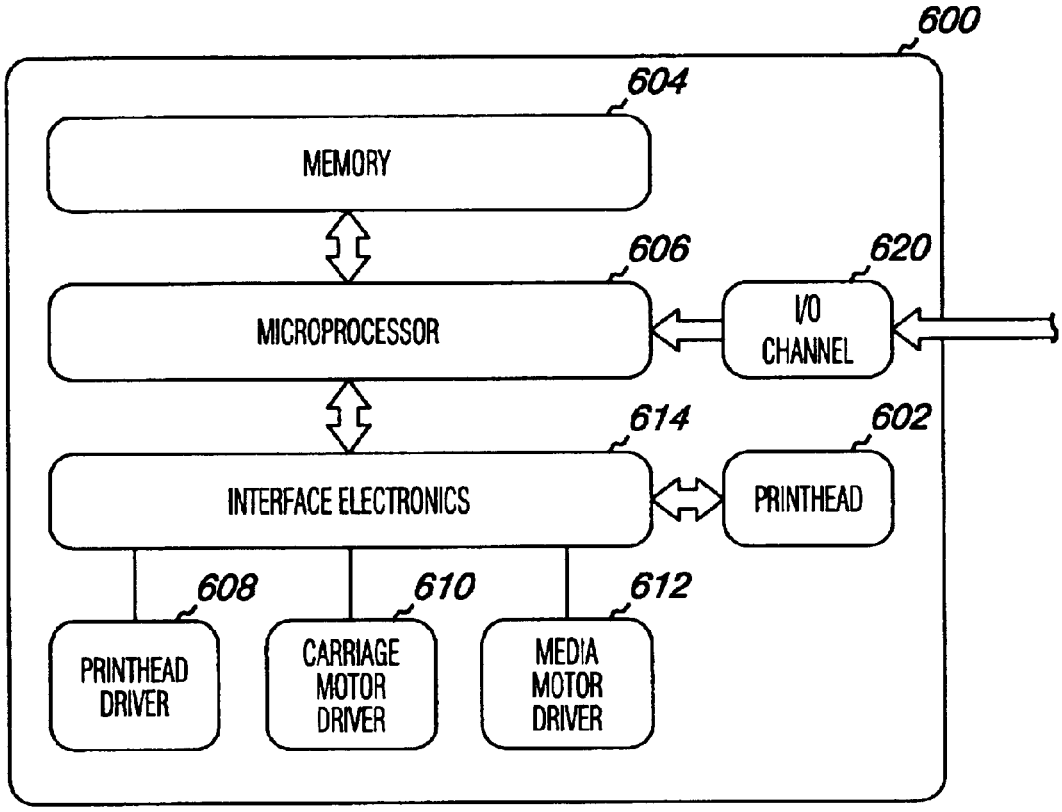
FIG. 6 illustrates an embodiment of the electronic components associated with a printer.

FIG. 6 illustrates an embodiment of the electronic components associated with a printer 600, such as printer 502 in FIG. 5. As shown in FIG. 6, the printer 600 includes a printhead 602. Each printhead has multiple nozzles (shown in FIG. 7). Printer 600 includes control logic in the form of executable instructions which can exist with a memory 604 and be operated on by a controller or processor 606. The processor 606 is operable to read and execute computer executable instructions received from memory 604. The executable instructions carry out various control steps and functions for a printer. The executable instructions are operable to perform the embodiments described herein. Memory 604 can include some combination of ROM, dynamic RAM, and/or some type of nonvolatile and writeable memory such as battery-backed memory or flash memory.

FIG. 6 illustrates a printhead driver 608, a carriage motor driver 610, and a media motor driver 612 coupled to interface electronics 614 for moving the printhead 602 and media, and for firing individual nozzles. The printhead driver 608, the carriage motor driver 610, and the media motor driver 612 can be independent components or combined on one or more application specific integrated circuits (ASICs). The embodiments, however, are not so limited. Computer executable instructions, or routines, can be executed by these components. As shown in the embodiment of FIG. 6, the interface electronics 614 interface between control logic components and the electromechanical components of the printer such as the printhead 602.

Figure 9:
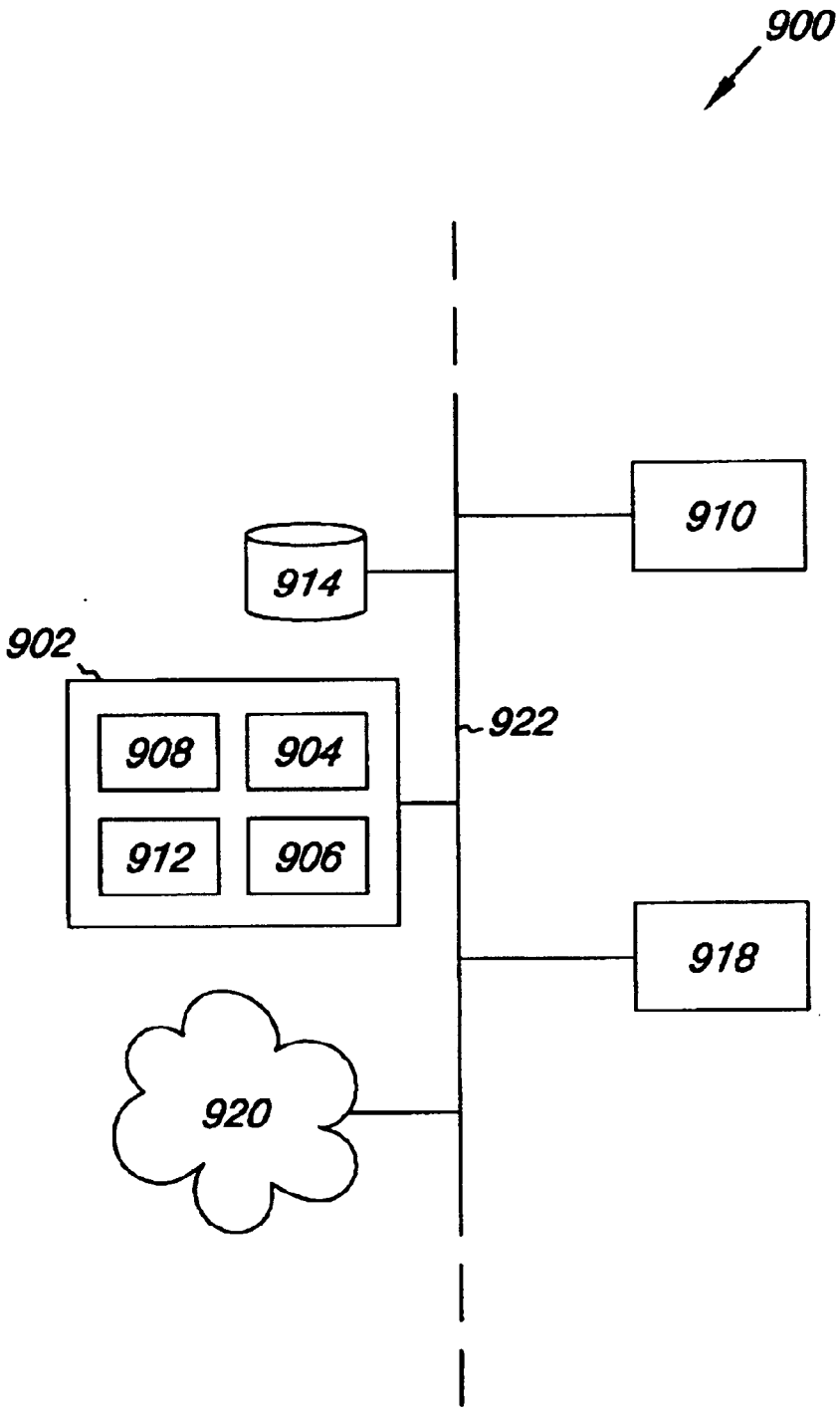
FIG. 9 illustrates a system or network environment in which embodiments can be implemented.

The processor 606 can be interfaced, or connected, to receive instructions and data from a remote device (e.g. host computer), such as 910 shown in FIG. 9, through one or more I/O channels or ports 620. I/O channel 620 can include a parallel or serial communications port, and/or a wireless interface for receiving information, e.g. print job data.

Figure 7:
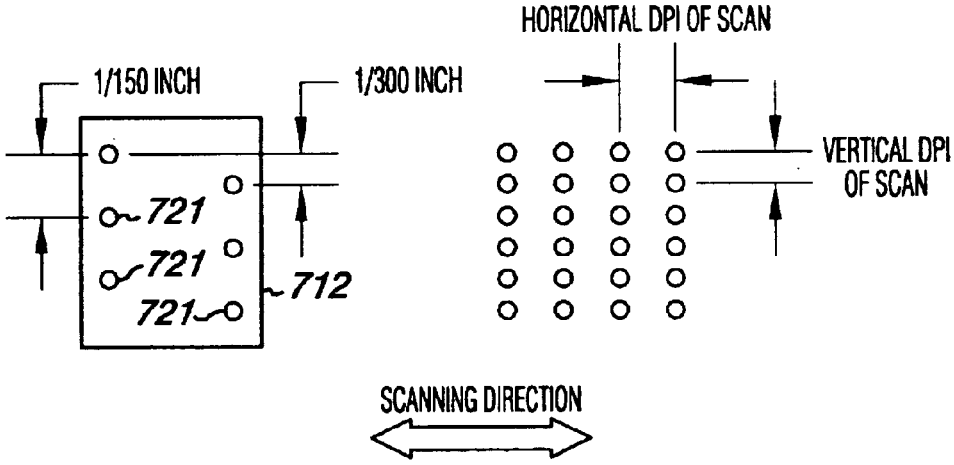
FIG. 7 illustrates an embodiment of a printhead.

FIG. 7 illustrates an embodiment of a printhead 712 which can serve as the printhead 602 shown in FIG. 6. As shown in the embodiment of FIG. 7, the printhead 712 includes a layout of nozzles 721. Printhead 712 can have one or more laterally spaced nozzle or dot columns. Each nozzle 721 is positioned at a different vertical position (where the vertical direction is the direction of print media travel, at a right angle to the direction of printhead travel, e.g. scanning direction), and corresponds to a respective pixel row on the underlying print media.

Many different printhead configurations are possible, and the embodiments of the invention are not limited to the example shown in FIG. 7. For example, in one embodiment a printhead can have nozzles corresponding to 300 pixel rows. Also, some printheads utilize redundant columns of nozzles for various purposes. A printhead can have an arrangement of 300 nozzles in a vertical column or may have 150 in one vertical column and another 150 offset in a second vertical column. In this example, the nozzles can be spaced at 1/300th of an inch such that the printhead is referred to as having a printhead vertical resolution of 300 DPI (dots per inch) or a 300 DPI packing density. A certain width strip of the media corresponding to the layout of the nozzle arrangement, can be printed during each scan of the printhead. FIG. 7, illustrates the distinction between a printed horizontal DPI of a scan.

Color printers typically have three or more sets of printhead nozzles positioned to apply ink droplets of different colors on the same pixel rows. In various embodiments the sets of nozzles can be contained within a single printhead, or incorporated in three different printheads, e.g. one each for cyan, magenta, and yellow. The principles of the invention described herein apply in either case.

According to embodiments of the invention, the printhead 712 is responsive to the control logic implemented by a controller and memory, e.g. 614 and 615 in FIG. 6, to pass repeatedly across a print media and to print non-uniform resolutions per raster in a contiguous block of rasters. The individual nozzles of a given printhead are fired repeatedly during each printhead scan to apply an ink pattern to a print media. The printhead 712 is responsive to the control logic implemented by a controller and memory, e.g. 614 and 615 in FIG. 6 to print a non-integral average number of drops per pixel in a contiguous block of rasters.

Figure 8:
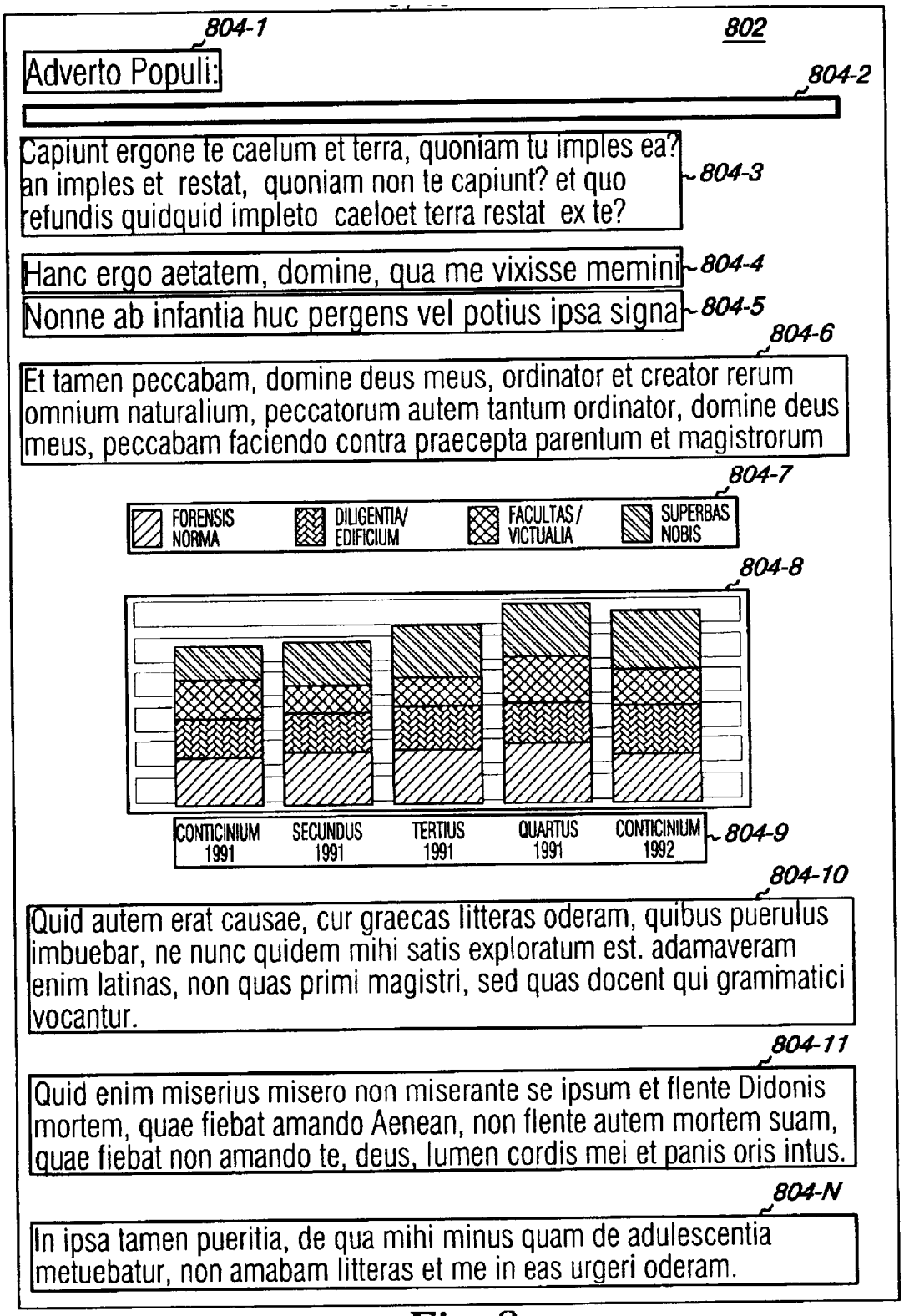
FIG. 8 illustrates an embodiment of a document separated into contiguous print regions.

FIG. 8 illustrates an embodiment of a document separated into contiguous print regions. In the embodiment of FIG. 8, it is noted that a contiguous print region typically has a blank space above and a blank space below in a direction orthogonal to a scan direction. In the embodiment of FIG. 8, input data representing the text and graphics to be printed on a piece of print media 802 are operated on by computer executable instructions to define one or more separate contiguous print regions, 804-1, . . . , 804-N. The contiguous print regions contain contiguous vertical blocks of rasters. In the various embodiments, contiguous vertical blocks of rasters can be printed using non-uniform resolutions/speed per raster.

FIG. 9 illustrates that a printing device, including the embodiments described herein, can be incorporated as part of a system 900. Thus, FIG. 9 illustrates a printing device 902, such as an inkjet printer. The printing device 902 is operable to print onto print media, substrates, and surfaces of various nature according the embodiments described herein.

The printing device 902 is operable to receive data and interpret the data to position an image in a particular image position. The system 900 can include software and/or application modules thereon for receiving and interpreting data, and controlling printhead and media movement, in order to achieve the positioning, formatting, and printing functions. As one of ordinary skill in the art will appreciate, the software and/or application modules can be located on any device that is directly or indirectly connected to the printing device 902 within the system 900.

In various embodiments, including the embodiment shown in FIG. 9, the printing device 902 can include a controller 904 and a memory 906 such as the controller and memory discussed in connection with FIG. 6. The controller 904 and memory 906 are operable to implement the method embodiments described herein. In the various embodiments, the memory 906 includes memory 906 on which data, including computer readable instructions, and other information of the like can reside.

In the embodiment shown in FIG. 9, the printing device 902 can include a printing device driver 908 and a print engine 912. In various embodiments of FIG. 9, additional printing device drivers can be located off the printing device, for example, on a remote device 910. Such printing device drivers can be an alternative to the printing device driver 908 located on the printing device 902 or provided in addition to the printing device driver 908. As one of ordinary skill in the art will understand, a printing device driver 908 is operable to create a computer readable instruction set for a print job utilized for rendering an image by the print engine 912. Printing device driver 908 includes any printing device driver suitable for carrying out various aspects of the present invention. That is, the printing device driver can take data from one or more software applications and transform the data into a print job.

When a printing device is to be utilized to print an image on a piece of print media, a print job can be created that provides instructions on how to print the image. These instructions are communicated in a Page Description Language (PDL) to initiate a print job. The PDL can include a list of printing properties for the print job. Printing properties include, by way of example and not by way of limitation, the size of the image to be printed, its positioning on the print media, resolution data of a print image (e.g. DPI), color settings, simplex or duplex setting, indications to process image enhancing algorithms (e.g. halftoning), and the like.

As shown in the embodiment of FIG. 9, printing device 902 can be networked to one or more remote devices 910 over a number of data links, shown as 922. As one of ordinary skill in the art will appreciate upon reading this disclosure, the number of data links 922 can include one or more physical and one or more wireless connections, including but not limited to electrical, optical, and RF connections, and any combination thereof, as part of a network. That is, the printing device 902 and the one or more remote devices 910 can be directly connected and can be connected as part of a wider network having a plurality of data links 922.

In various embodiments, a remote device 910 can include a device having a display such as a desktop computer, laptop computer, a workstation, hand held device, or other device as the same will be known and understood by one of ordinary skill in the art. The remote device 910 can also include one or more processors and/or application modules suitable for running software and can include one or more memory devices thereon.

As shown in the embodiment of FIG. 9, a system 900 can include one or more networked storage devices 914, e.g.

remote storage database and the like, networked to the system. Likewise, the system 900 can include one or more peripheral devices 918, and one or more Internet connections 920, distributed within the network.

Memory, such as memory 906 and memory 914, can be distributed anywhere throughout a networked system. Memory, as the same is used herein, can include any suitable memory for implementing the various embodiments of the invention. Thus, memory and memory devices include fixed memory and portable memory. Examples of memory types include Non-Volatile (NV) memory (e.g. Flash memory), RAM, ROM, magnetic media, and optically read media and includes such physical formats as memory cards, memory sticks, memory keys, CDs, DVDs, hard disks, and floppy disks, to name a few.

The system embodiment 900 of FIG. 9 can include one or more peripheral devices 918. Peripheral devices can include any number of peripheral devices in addition to those already mentioned herein. Examples of peripheral devices include, but are not limited to, scanning devices, faxing devices, copying devices, modem devices, and the like.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the invention. It is to be understood that the above description has been made in an illustrative fashion, and not a restrictive one. Combination of the above embodiments, and other embodiments not specifically described herein will be apparent to those of skill in the art upon reviewing the above description. The scope of the various embodiments of the invention includes any other applications in which the above structures and methods are used. Therefore, the scope of various embodiments of the invention should be determined with reference to the appended claims, along with the full range of equivalents to which such claims are entitled.

It is emphasized that the Abstract is provided to comply with 37 C.F.R. § 1.72(b) requiring an Abstract that will allow the reader to quickly ascertain the nature of the technical disclosure. It is submitted with the understanding that it will not be used to limit the scope of the claims.

In the foregoing Detailed Description, various features are grouped together in a single embodiment for the purpose of streamlining the disclosure. This method of disclosure is not to be interpreted as reflecting an intention that the embodiments of the invention require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A method for printing, comprising:

receiving a print job; and performing the print job, wherein performing the print job includes printing non-uniform resolutions per raster in a contiguous block of rasters, including:

printing a first pass of a first raster at a first horizontal resolution;

printing a second pass of the first raster at a second horizontal resolution; and printing a first pass of a second raster at the first horizontal resolution.

2. The method of claim 1, wherein printing non-uniform resolutions per raster in a contiguous block of rasters includes printing all rasters in the contiguous block of rasters during a first time period which is less than a second time period which would be used to print all rasters in the contiguous block at the same horizontal resolution setting.

3. The method of claim 1, wherein printing non-uniform resolutions per raster in a contiguous vertical block of rasters includes printing a non-integral average number of drops per pixel in the contiguous block of rasters.

4. A method for non-uniform resolution printing, comprising:

interpreting a print job instruction set; and modifying the print job instruction set to print non-uniform resolutions per raster within a contiguous block of rasters, including:

printing a first pass of a first raster at a first horizontal resolution;

printing a second pass of the first raster at a second horizontal resolution; and printing a first pass of a second raster at the first horizontal resolution.

5. The method of claim 4, wherein modifying the print job instruction set to print non-uniform resolutions per raster further includes printing a third raster in a third pass at a third horizontal resolution and printing a fourth raster in a fourth pass at a fourth horizontal resolution.

6. The method of claim 5, wherein printing a third raster in the third pass at a third horizontal resolution and printing a fourth raster in the fourth pass at a fourth horizontal resolution includes printing with the third and the fourth horizontal resolutions which are different from the first and the second horizontal resolutions.

7. A computer readable medium having a set of executable instructions for causing a device to perform a method, comprising:

interpreting the type of information contained in a print job for a region of media; and adjusting the print job to print non-uniform resolutions per raster within a contiguous block of rasters, including:

printing a first pass of a first raster at a first horizontal resolution;

printing a second pass of the first raster at a second horizontal resolution; and printing a first pass of a second raster at the first horizontal resolution.

8. The medium of claim 7, wherein interpreting the type of information contained in a print job for a region of media includes interpreting resolution data and print mode settings.

9. The medium of claim 7, wherein adjusting the print job includes printing a number of rasters in the contiguous block of rasters in less time than for printing the number of rasters using a single resolution for each raster pass.

10. An apparatus, comprising:

a controller;

a printhead coupled to the controller; and a printhead driver operable to interface the instructions from the controller to the printhead, wherein the instructions include instructions to cause the printhead to print at non-uniform resolutions per raster in a contiguous block of rasters, including:

printing a first pass of a first raster at a first horizontal resolution;

printing a second pass of the first raster at a second horizontal resolution; and printing a first pass of a second raster at the first horizontal resolution.

11. The apparatus of claim 10, wherein the instructions include instructions to print a non-integral average number of drops per pixel in the contiguous block of rasters.

12. A printing device, comprising:

a printhead; and means for controlling the printhead to print non-uniform resolutions per raster in a contiguous block of rasters, including:

printing a first pass of a first raster at a first horizontal resolution;

printing a second pass of the first raster at a second horizontal resolution; and printing a first pass of a second raster at the first horizontal resolution.

13. The device of claim 12, wherein the means includes a controller interfaced with printhead driver electronics to control the printhead.

14. A printing device, comprising:

a printhead driver;

a carriage motor driver;

a media motor driver;

a processor;

a printhead;

wherein the printhead driver, the carriage motor driver, the media motor driver, the processor, and the printhead are coupled via interface electronics for moving the printhead and media, and for firing individual nozzles of the printhead; and wherein the printhead driver is operable to interface an instruction set from the processor to the printhead, wherein the instruction set includes instructions to cause the printhead to perform non-uniform resolutions per raster in a contiguous block of rasters, including:

printing a first pass of a first raster at a first horizontal resolution;

printing a second pass of the first raster at a second horizontal resolution; and printing a first pass of a second raster at the first horizontal resolution.

15. An imaging system, comprising:

a remote device having an application operable to create a print job; and a printing device operable to receive the print job from the remote device, wherein the printing device include;

a controller;

a printhead coupled to the controller; and a printhead driver operable to interface an instruction set from the controller to the printhead, wherein the instructions include instructions to cause the printhead to perform non-uniform resolutions per raster in a contiguous block of rasters, including:

printing a first pass of a first raster at a first horizontal resolution;

printing a second pass of the first raster at a second horizontal resolution; and printing a first pass of a second raster at the first horizontal resolution.

16. The system of claim 15, wherein the instructions include instructions to cause the printhead to print a non-integral average number of drops per pixel in the contiguous block of rasters.

* * * * *